US006473980B2

(12) United States Patent
Ripingill, Jr. et al.

(10) Patent No.: US 6,473,980 B2
(45) Date of Patent: Nov. 5, 2002

(54) INFRARED LASER TRANSMITTER ALIGNMENT VERIFIER AND TARGETING SYSTEM

(75) Inventors: Allen E. Ripingill, Jr.; John B. Roes; David A. Robinson, all of San Diego, CA (US)

(73) Assignee: Cubic Defense Systems, Inc., San Diego, CA (US)

( * ) Notice: Subject to any disclaimer, the term of this patent is extended or adjusted under 35 U.S.C. 154(b) by 2 days.

(21) Appl. No.: 09/727,809

(22) Filed: Nov. 30, 2000

(65) Prior Publication Data

US 2002/0064761 A1 May 30, 2002

(51) Int. Cl.[7] ..... G01B 1/00; F41G 1/00

(52) U.S. Cl. ..... 33/506; 33/286; 33/275 R; 33/DIG. 21; 42/114; 42/115

(58) Field of Search ..... 33/286, 275 R, 33/506, DIG. 21, 1 T, 227, 228, 293; 42/114, 115; 250/338.1, 339.02, 339.11

(56) References Cited

U.S. PATENT DOCUMENTS

| | | | | | |
|---|---|---|---|---|---|
| 3,633,285 | A | * | 1/1972 | Sensney | 434/22 |
| 3,904,163 | A | * | 9/1975 | Kendy et al. | 248/565 |
| 5,410,815 | A | | 5/1995 | Parikh et al. | |
| 5,426,295 | A | | 6/1995 | Parikh et al. | 250/227 |
| 5,476,385 | A | | 12/1995 | Parikh et al. | 434/22 |
| 5,771,099 | A | * | 6/1998 | Ehbets | 33/293 |
| 6,061,918 | A | | 5/2000 | Schnell | |
| 6,068,484 | A | * | 5/2000 | O'Loughlin et al. | 434/22 |
| 6,315,568 | B1 | * | 11/2001 | Hull et al. | 434/22 |

FOREIGN PATENT DOCUMENTS

| | | | | |
|---|---|---|---|---|
| JP | 01201114 | * | 8/1989 | 33/293 |

* cited by examiner

*Primary Examiner*—Diego Gutierrez
*Assistant Examiner*—Travis Reis
(74) *Attorney, Agent, or Firm*—Michael H. Jester

(57) ABSTRACT

A relatively inexpensive system is provided for detecting and visually indicating the relative location of the impact on a target of an invisible infrared laser beam emitted from a small arms transmitter (SAT) mounted on a combat rifle. A plurality of red LEDs are mounted on a planar PCB that serves as the target and are arranged along X and Y axes corresponding to azimuth and elevation. A plurality of photo-diodes are mounted on the PCB for generating output signals when struck by the laser beam. The photo-diodes are clustered around the intersection of the X and Y axes. A circuit mounted on a reverse side of the PCB is connected to the plurality of photo-diodes for receiving their output signals. The circuit energizes one or more of the red LEDs to provide a pattern of illumination of the LEDs that represents azimuth and elevation deviation of the laser hit from the intersection of the axes when the SAT is fired with the intersection of the axes in the iron sights of the rifle. The LEDs and photo-diodes are spatially arranged on the PCB to provide an effective magnification of a variation in azimuth and elevation of the location of the impact of the laser beam relative to the intersection of the axes. The circuit also increases the duration of the illumination of the LEDs compared to short duration laser pulses to increase visibility to the soldier. A pair of laser diodes can be mounted on the PCB so that visible red light beams emitted therefrom will criss-cross at the appropriate distance and overlap on the soldier's chest. This tells the soldier to fire the SAT-equipped rifle at the target at this location.

19 Claims, 4 Drawing Sheets

INFRARED LASER TRANSMITTER ALIGNMENT VERIFIER AND TARGETING SYSTEM

CROSS-REFERENCE TO RELATED U.S. PATENTS AND APPLICATIONS

This application is related to U.S. Pat. No. 5,410,815, issued May 2, 1995 and entitled "Automatic Player Identification Small Arms Laser Alignment System," U.S. Pat. No. 5,476,385, issued Dec. 19, 1995 and entitled "Laser Small Arms Transmitter," and U.S. Pat. No. 5,426,295, issued Jun. 20, 1995 and entitled "Multiple Integrated Laser Engagement System Employing Fiber Optic Detection Signal Transmission", the entire disclosures of which are hereby incorporated herein by reference. This application is also related to pending U.S. patent application Ser. No. 09/025,482 filed Feb. 18, 1998 and entitled "Laser Diode Assembly for Use in a Small Arms Transmitter" and to pending U.S. patent application Ser. No. 09/596,674 filed Jun. 19, 2000 and entitled "Low Cost Laser Small Arms Transmitter and Method of Aligning the Same", the entire disclosures of which are hereby incorporated by reference. This application and the aforementioned U.S. patents and applications are all assigned to Cubic Defense Systems, Inc. of San Diego, Calif., United States of America.

BACKGROUND OF THE INVENTION

1. Field of Invention

The present invention relates to energy beam detection equipment, and more particularly, to an improved system for detecting the point of impact of an infrared laser beam remote from its point of transmission and providing a visual indication of the point of impact for alignment, targeting, verification and other purposes.

2. Description of Related Art

For many years the U.S. Army has trained soldiers with a multiple integrated laser engagement system (MILES). One aspect of MILES involves a small arms transmitter (SAT) being affixed to the barrel of a small arms weapon such as an M16A1 rifle or a machine. When the soldier pulls the trigger of his or her weapon blank cartridges are ignited to simulate the firing of an actual round or multiple rounds. An audio sensor and a photo-optic sensor in the SAT detect the firing of the blank round(s) and simultaneously energize an infrared laser diode in the SAT which emits an invisible energy beam of very short pulse duration toward a target which is in the conventional sights of the weapon. Each soldier is fitted with detectors on his or her helmet and on a body harness adapted to detect an invisible laser "bullet" hit.

According to one prior art approach, the SAT was bolted to the rifle barrel and the conventional sights of the weapon were adjusted to align with the laser beam. The disadvantage of this approach is that the conventional weapon sights had to be readjusted in order to use the rifle with live rounds. Thus the rifle was rendered useless for actual combat unless and until it was zeroed, i.e. the iron sights of the rifle were aligned by firing live ammunition at a target. To overcome this disadvantage, later SATs incorporated mechanical adjustors for manually changing the orientation, i.e. azimuth and elevation, of the laser beam.

Aligning a SAT has generally been performed using a fixture. One type of prior art small arms alignment fixture (SAAF) that has been used by the U.S. Army for aligning a manually adjustable SAT consists of a complex array of one hundred forty-four detectors which are used in conjunction with thirty-five printed circuit boards to determine where the laser hits with respect to a target. The prior art SAAF calculates the number of error "clicks" in both azimuth and elevation. The number of clicks is then displayed by the SAAF using four sets of electro-mechanical display indicators. A soldier must turn his or her SAT's adjustors the corresponding number of clicks in the correct direction. He or she must then aim and fire the weapon again and make additional turns to the SAT's adjustors. This iterative process continues until the soldier obtains a zero indication on the prior art SAAF.

A SAT which eliminates the need to utilize the prior art SAAF has been developed by Cubic Defense Systems, Inc. and deployed by the U.S. Army as part of Cubic's MILES 2000® ground combat training system. The exercise events and casualties are recorded, replayed and analyzed in detail during "after action reviews" (AARs). The MILES 2000 SAT is automatically adjustable for more rapid and accurate alignment of its laser output. The MILES 2000 SAT features adjustable powers and encoding to enable the man-worn portion of the MILES 2000 system to discriminate between kills made by different small arms and different players.

The MILES 2000 SAT is disclosed in the aforementioned U.S. Pat. No. 5,476,385 of Parikh et. al. It uses a pair of optical wedges that are rotated to steer the laser beam and align the same with the optical or so-called "iron" sights of the rifle. This approach, while achieving a reasonable degree of aligning the laser beam with the iron sights, requires a relatively expensive construction of the MILES 2000 SAT. This is attributable to the cost of the beam steering components such as the glass wedges, stainless steel gears, shafts, drive gears, housing, etc. The components must be small in size which makes mechanical design tolerances extremely tight. Furthermore the MILES 2000 SAT—equipped rifle must be inserted into a portable box-like MILES 2000 automatic small arms alignment fixture (ASAAF) in order to accomplish the laser alignment in a semi-automatic fashion. See the aforementioned U.S. Pat. No. 5,410,815 of Parikh et al. The portable MiLES 2000 ASAAF is a relatively expensive device which itself must be calibrated.

It would therefore be desirable to provide a low cost alternative to the SAAF and the ASAAF that would provide visual feedback to a soldier firing a rifle equipped with a manually adjustable SAT by indicating the approximate horizontal and vertical location of the impact of the invisible infrared beam relative to a target in the iron sights of the rifle. This would allow the soldier to manually align the laser beam of the SAT to the iron sights of the rifle. Alternatively, for those SATs that do not permit the aim of their laser beams to be manually adjusted, the visual feedback could be used in aligning the iron sights of the weapon to the laser beam.

SUMMARY OF THE INVENTION

Accordingly, it is the primary object of the present invention to provide an improved system for detecting the point of impact of an energy beam remote from its point of transmission and providing a visual indication of the point of impact for alignment, targeting and other purposes.

In accordance with the present invention, a system is provided for detecting and visually indicating the relative location of the impact of an energy beam emitted from a remote source. A plurality of detectors are mounted on a target for generating output signals when struck by a beam of energy emitted from a remote source aimed at the target. A plurality of luminescent devices are mounted on the target for generating visible light when energized. A circuit is connected to the plurality of detectors for receiving the output signals. The circuit energizes preselected ones of the luminescent devices to provide a visual indication of a relative location of an impact on the target of the beam of energy. Although useful in a wide variety of applications, the system of the present invention may be advantageously employed in verifying the alignment of the invisible infrared laser beam emitted by a small arms transmitter (SAT) mounted on a rifle or other small arms weapon.

The present invention also provides a method of verifying an alignment of a beam of energy. The method includes the steps of providing a target and aiming a source remote from the target at the target, the source being capable of emitting a beam of energy. The method further includes the steps of causing the source to emit the beam of energy at the target, and detecting at the target, the location of an impact of the beam of energy on the target. The method further includes the step of providing, at the target, a visual indication of the location of the impact.

BRIEF DESCRIPTION OF THE DRAWINGS

The nature, objects, and advantages of the present invention will become more apparent to those skilled in the art after considering the following detailed description in conjunction with the accompanying drawings, in which like reference numerals designate like parts throughout, wherein.

DETAILED DESCRIPTION OF THE PREFERRED EMBODIMENTS

Figure 1:
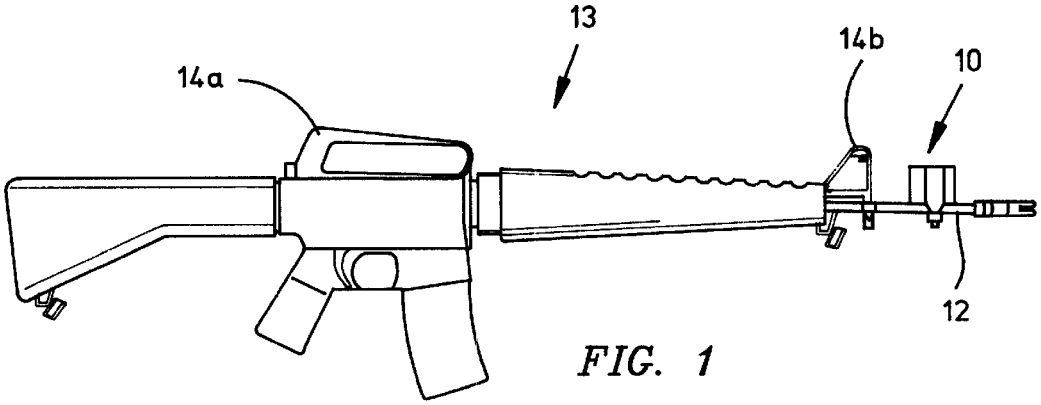
FIG. 1 is a side elevation view of an M16A1 rifle equipped with a SAT.

Referring to FIG. 1, a laser small arms transmitter (SAT) 10 is bolted to the barrel 12 of a small arms weapon such as an M16A1 rifle 13. The SAT equipped rifle 13 may then be used by a soldier in combat training exercises, which are sometimes referred to as "war games." The SAT 10 could also be used on the barrel of a machine gun, sniper rifle, hand gun or other small arms weapon. The SAT 10 may be of the type which can be manually adjusted by the soldier to align its laser beam in both azimuth and elevation. One example of this type of manually adjustable SAT is commercially available from Oscmar International of Aukland, New Zealand, which company has recently been acquired by Cubic Defense Systems, Inc. When properly aligned, the laser beam emitted by the SAT 10 will strike the same approximate location on the target at a predetermined distance, e.g. twenty-five meters, as a bullet fired from the rifle 13 when the target is in the optical or "iron" sights of the rifle 13. The iron sights of the M16A1 rifle include a rearward sight located at 14*a* nearer the soldier's eye and a forward sight 14*b* extending upwardly from the forward portion of the barrel 12. Alternatively, the SAT 10 may be of the type whose laser cannot be aligned or steered, in which case the iron sights of the rifle 13 must be adjusted or aimed so that the laser beam from the SAT 10 will strike at or near a particular location on a target that is in the iron sights.

The SAT 10 (FIG. 1) is an electro-mechanical device that "fires" an energy beam emitted by an infrared laser diode when the trigger of the rifle 13 is pulled. A player identification (PID) code may be encoded in the laser beam by any well known technique, such as intensity modulation, so that the identity of a soldier who has made a "kill" with the rifle can be ascertained. The power of the laser beam may also be adjusted to simulate different types of small arms.

Figure 2:
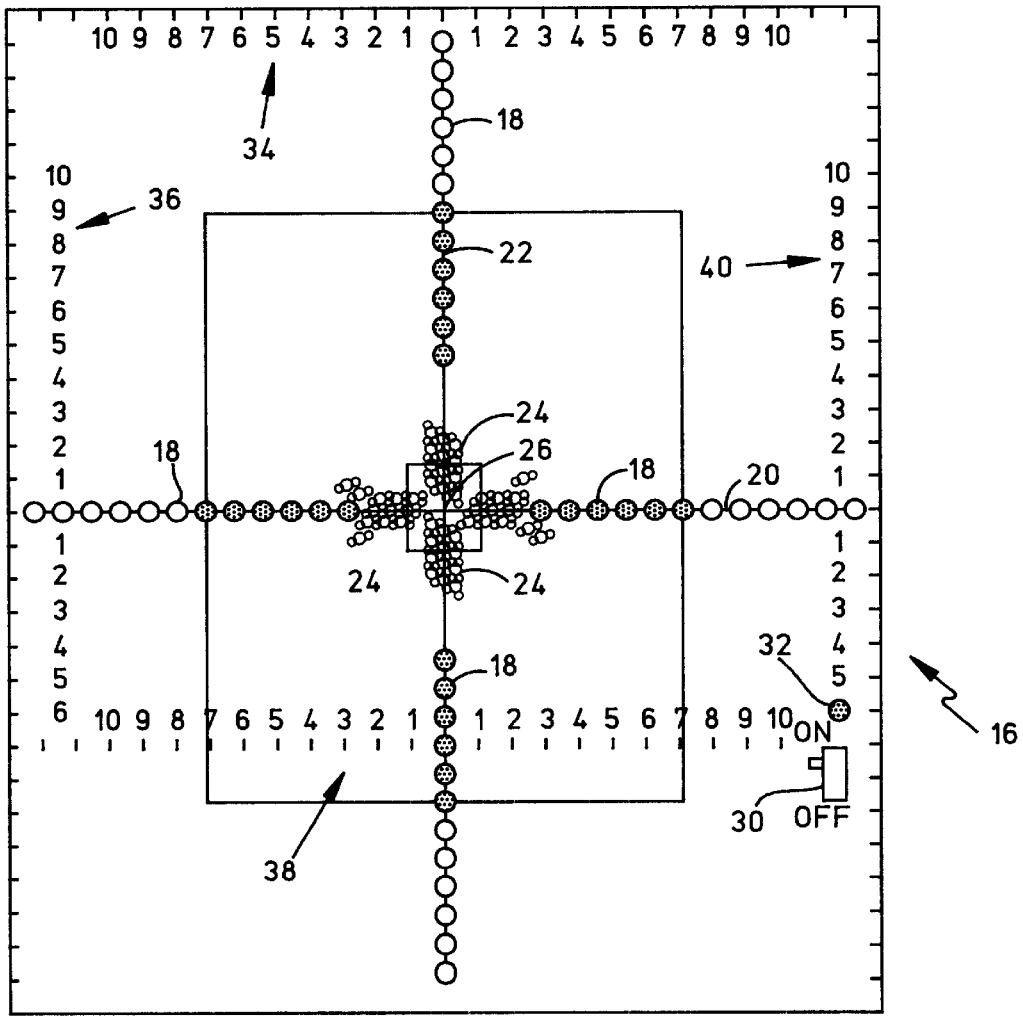
FIG. 2 is a plan view of a target forming a portion of an infrared laser transmitter alignment verifier and targeting system in accordance with a preferred embodiment of the present invention.

FIG. 2 is a plan view of a target 16 forming a portion of an infrared laser transmitter alignment verifier and targeting system in accordance with a preferred embodiment of the present invention. The target 16 comprises a rectangular planar printed circuit board (PCB) with plurality of luminescent devices in the form of forty-eight red LEDs 18 mounted on the forward side thereof The LEDs 18 are arranged along orthogonal horizontal and vertical axes 20 and 22 corresponding to azimuth and elevation, respectively. A plurality of infrared detectors in the form of forty-eight photo-diodes 24 are mounted on the forward side of the target 16 in four distinct clusters spaced adjacent to and around the intersection 26 of the axes 20 and 22. The intersection 26 provides a target cross-hair. The photo-diodes 24 are selected to detect invisible infrared radiation that impinges thereon when the beam emitted by the SAT 10 impacts the same. By way of example, the infrared laser beam may have an optical wavelength of approximately nine hundred and four nanometers. Other luminescent devices could be used such as incandescent light bulbs but LEDs are preferred due to their low cost and reliability. Other detectors could be used depending upon the frequency of the energy beam being detected. For example, photo-transistors or photo-darlington devices could be used in lieu of the photo-diodes 24.

Figure 3A:
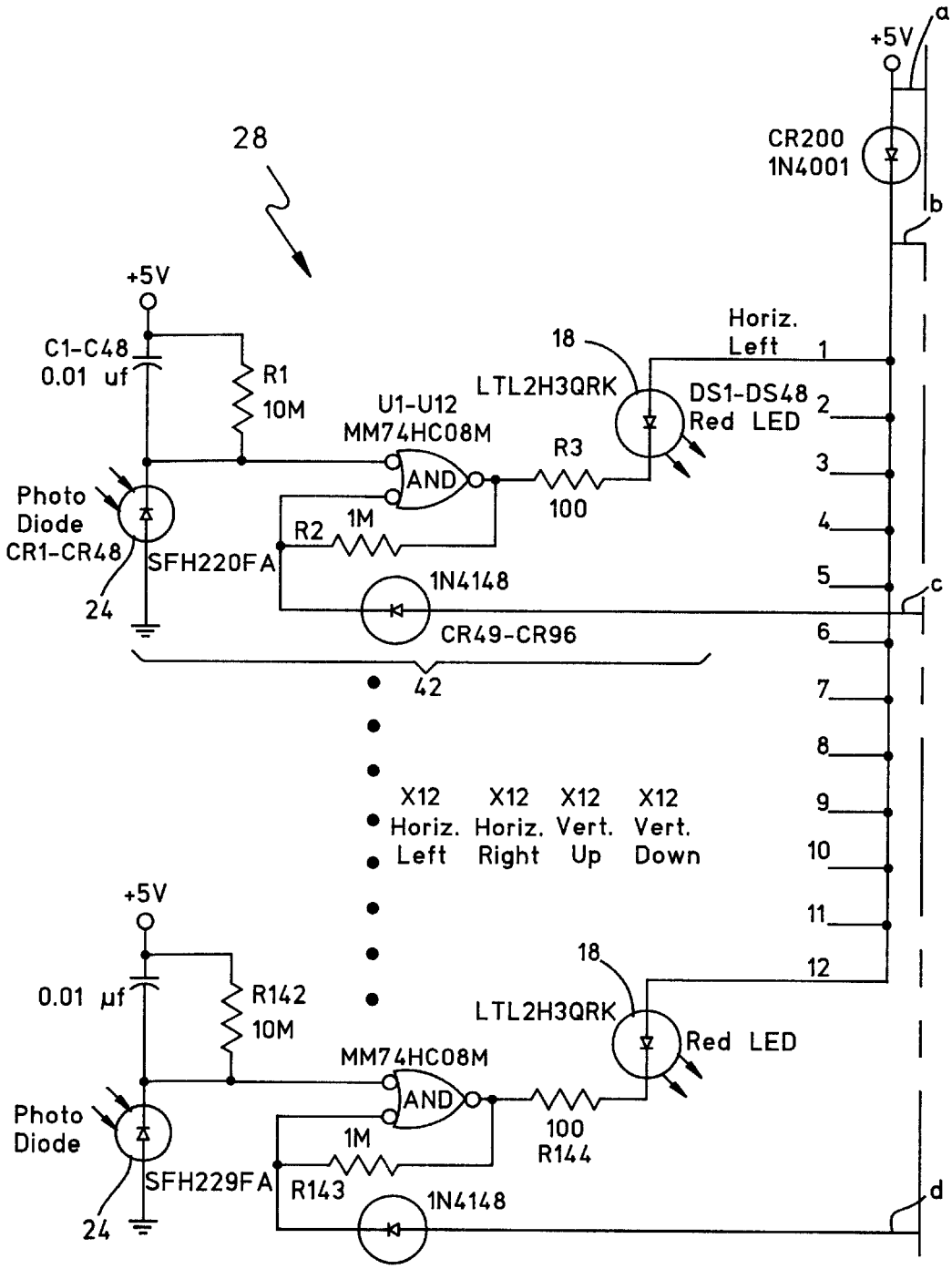
FIG. 3A and FIG. 3B are the left and right halves of a schematic diagram of the circuit portion of the preferred embodiment of the infrared laser transmitter alignment verifier and targeting system.
Figure 3B:
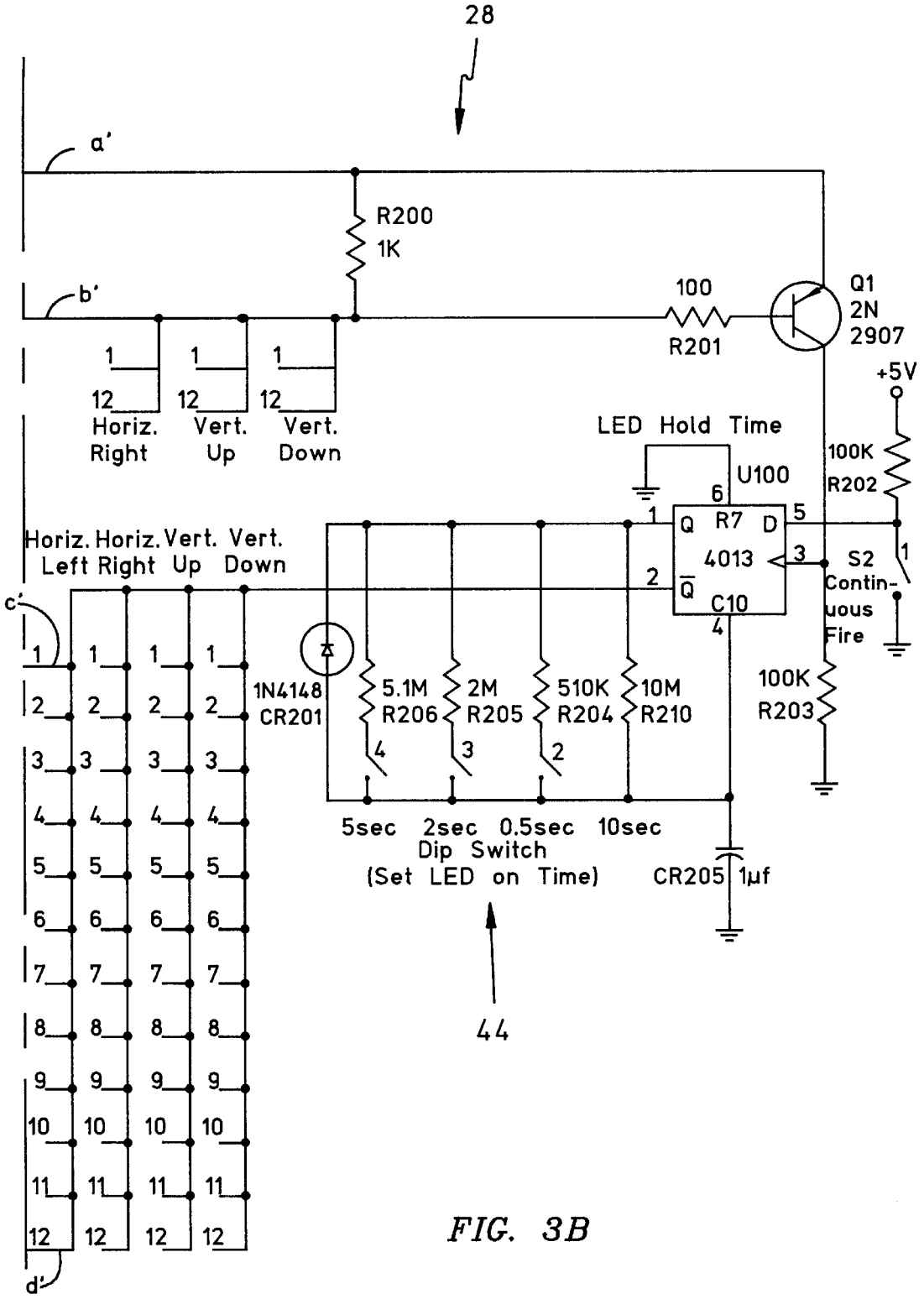

The LEDs 18 and the photo-diodes 24 (FIG. 2) that are mounted on the forward side of the target 16 are connected to a circuit 28 illustrated in FIGS. 3A and 3B. Lines a, b, c and d in FIG. 3A connect to lines a', b', c' and d' in FIG. 3B. The vertical dashed lines on right side of FIG. 3A and the left side of FIG. 3B represent the common break point of the two halves of the circuit 28.

When selectively energized, the LEDs 18 provide a low cost visual feedback to a soldier that shows the approximate horizontal and vertical displacement of the impact location of the infrared laser beam. This visual feedback occurs when the soldier fires at the target 16 with the intersection 26 of the axes 20 and 22 in the iron sights of the SAT equipped rifle 13. The firing distance between the rifle 13 and the target 16 (range) is typically a predetermined distance such as ten meters or twenty-five meters. A simple way to measure this distance is to mount a roll of string or tape (not illustrated) of appropriate length to the target 16 which can be pulled out by the soldier to measure off the appropriate firing distance or range from the target 16 to the weapon 13.

The circuit 28 (FIGS. 3A and 3B) is made up of a plurality of electronic components that are mounted on the rear side of the PCB and interconnected via solder connections and conductive traces. The front of the PCB utilizes a dark blue or black solder mask, along with the appropriate silkscreen to provide the required artwork illustrated in FIG. 2. This artwork includes numerical scales 34, 36, 38 and 40 to facilitate parallax adjustments to accommodate different energy beam geometries. An ON/OFF slide switch 30 (FIG. 2) is mounted on the forward side of the PCB along with a green LED 32 which is energized when the switch 30 is manually moved to its ON position. The circuit 28 (FIGS. 3A and 3B) is preferably powered by batteries (not illustrated). A light illuminating surface (not illustrated) could be mounted on the forward side of the PCB for night operation.

Energy beam pulses emitted by the laser diode inside the SAT 10 are invisible to the naked eye because they are in the infrared wavelength range. Even if the energy beam were in the visible wavelength, the duration of the pulses from the SAT 10 is too short (e.g. two hundred nanoseconds) to be seen with the naked eye. In addition, the luminous spot of impact on the target 16 would be too small to see from a typical range often meters or twenty-five meters. The infrared laser beam from the SAT 10 is typically a nominal three to four milliradian when emitted from the SAT 10 which at ten meters corresponds to thirty to forty millimeters. As illustrated in FIGS. 3A and 3B, the circuit 28 maps the clusters of forty-eight photo-diodes 24 to corresponding ones of the LEDs 18 via identical sub-circuits such as 42. The LEDs 18 extend along the horizontal and vertical axes 20 and 22 well beyond the clusters of photo-diodes 24.

Each of the four separate clusters of the photo-diodes 24 use one dozen T1 size detector devices with two millimeter spacing to cover an area roughly twenty-two millimeters in longest dimension. The first horizontal photo-diode is spaced five millimeters from the intersection 26. The LEDs 18 are spaced ten millimeters apart, which is five times more than the spacing between the photo-diodes 24. This provides an effective 5× magnification of the indicated amount of variation or offset in azimuth and elevation of the location of the impact of the infrared laser beam relative to the intersection 26 of the axes 20 and 22. This spatial arrangement of the LEDs 18 and photo-diodes 24 facilitates easier and more accurate alignment and target practice.

Referring to FIG. 3A, each sub-circuit 42 includes a photo-detector circuit comprising the corresponding photo-diode 24 (CR1), a capacitor C1 and a resistor R1. The capacitor C1 and resistor R1 convert the infrared photon energy to electrical energy and act as a peak detector and pulse stretcher. The infrared energy causes the photo-diode CR1 to turn ON and act as a current source charging the capacitor C1 below the threshold of an AND gate U1. The resistor R1 is used both to set the photo-sensitivity and to discharge the capacitor C1 slowly back to the threshold of the AND gate U1, resulting in a time-stretched or increased duration pulse.

Each sub-circuit 42 (FIG. 3A) further includes a set/reset flip-flop circuit comprising the AND gate U1, a feedback resistor R2 and a diode CR49 form. This flip-flop circuit receives a negative going pulse from the photo-detector circuit and latches the pulse through the feedback resistor R2. This represents the set function of the flip-flop circuit. The reset function of the flip-flop circuit occurs when a positive pulse is applied to the anode of the diode CR49. The reset function occurs after a predetermined time delay which allows the LED 18 to stay ON long enough for the soldier to see the same.

Each sub-circuit 42 (FIG. 3A) also includes a display circuit comprising a resistor R3 and the corresponding LED 18 (DS1). The display circuit converts the output from the flip-flop circuit to a visible optical signal for the soldier aligning his or her weapon or for use in target practice.

The reset function of the forty-eight flip-flop circuits is attributable to a one-shot integrated circuit device U100 (FIG. 3B) which is triggered from any LED current that passes through a current sense diode CR200. The diode CR200 is selected because of its large geometry compared to the small geometry base-emitter drop of a bi-polar transistor Q1 to which it is connected. This large geometry causes enough voltage drop to guarantee the turn ON voltage necessary for the small geometry transistor Q1. Therefore, the transistor Q1 turns ON if one or more of the LEDs 18 are ON, which occurs when one or more of the photo-diodes 24 receive sufficient infrared energy from the impinging laser beam.

The one-shot device U100 (FIG. 3B) is triggered by the first pulse from a burst of the laser beam emitted by the SAT 10. This disables the reset inputs to the flip-flop circuits, keeping them latched during the time constant of the one-shot device. When this predetermined time constant has elapsed, all of the flip-flop circuits are reset simultaneously, preparing the system for the next burst from the SAT 10.

A DIP switch 44 (FIG. 3B) is used to select the predetermined time constant for the one-shot device U100. When switch #1 of the DIP switch 44 is ON the one-shot device U100 is disabled. In this condition, the LEDs 18 will only illuminate during the duration of the laser pulse and the short pulse stretching from the input pulse stretcher consisting of resistor R1 and capacitor C1. Switch #2, #3 and #4 set the time constant for the one-shot device U100 to 0.5, two and five seconds, respectively. When all four of the switches of the DIP switch 44 are OFF, the time constant for the one-shot device U100 is ten seconds.

The SAT equipped rifle 13 (FIG. 1) is normally fired at the target 16 (FIG. 2) with the intersection 26 (target cross-hair) in the iron sights of the rifle 13. The number of the red LEDs 18 that light up above and below the horizontal axis 20 should not differ by more than three. Similarly, the number of red LEDs 18 that light up to the left and right of the vertical axis 22 should not differ by more than three in the preferred embodiment. In the example described, a difference of three illuminated red LEDs 18 corresponds to an error of 0.6 milliradian. Where the SAT 10 has a manually adjustable laser beam the appropriate adjustments can be made to the SAT's adjustors in order to align the laser beam with the iron sights of the rifle 13. Where the SAT is not manually adjustable, the iron sights themselves must be adjusted.

Figure 4:
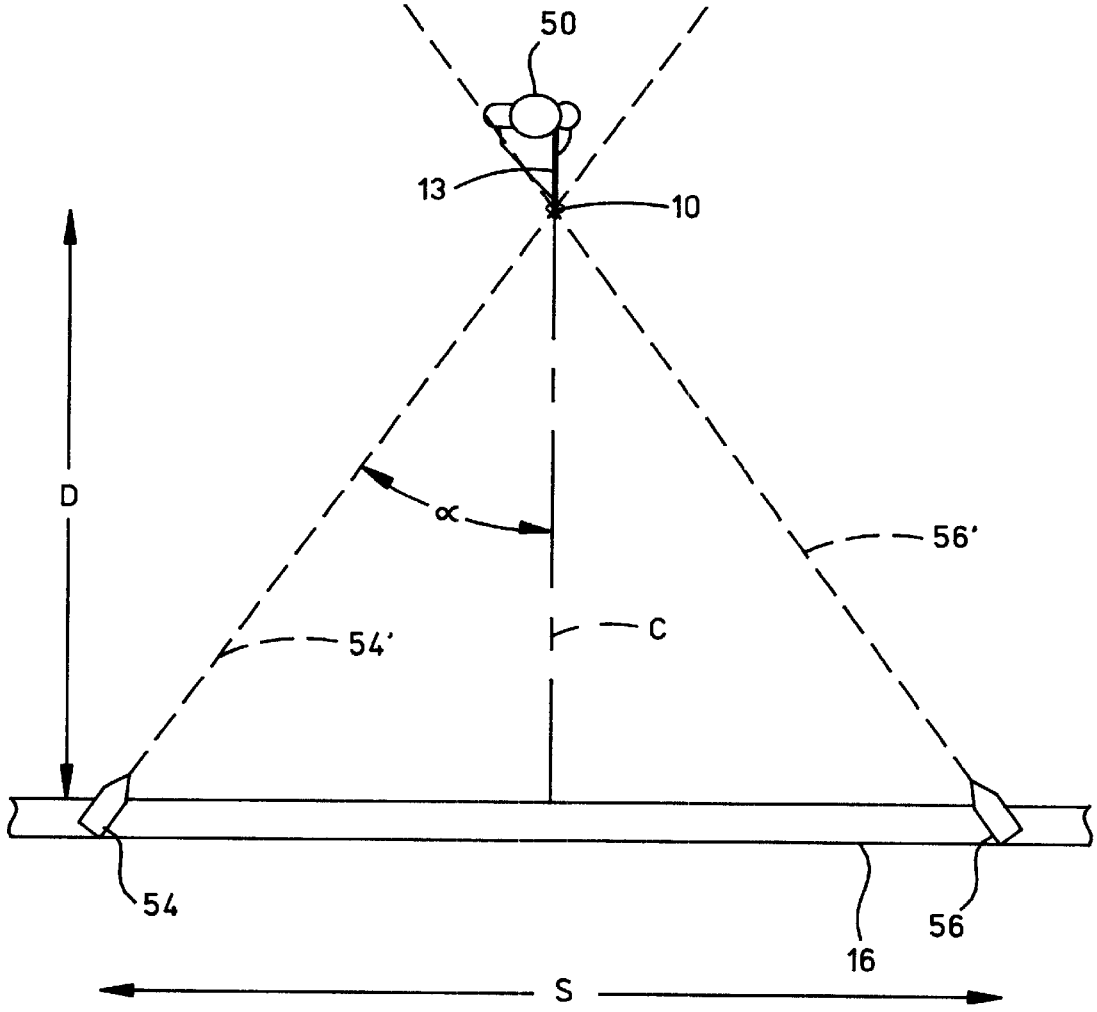
FIG. 4 is a diagrammatic illustration of an alternate embodiment of the invention which incorporates a crossing laser beam distance indicating feature.

When a bullet is fired from a rifle, it follows a curved trajectory due to the influence of gravity. A laser beam emitted from a SAT follows a straight trajectory. Accordingly, the alignment of a SAT equipped rifle should be accomplished a predetermined distance from the target 16, such as ten meters or twenty-five meters. Also, since the photo-diodes 24 have a limited field of view, e.g. twenty degrees, it is important for the SAT equipped rifle to be pointed generally perpendicular to the plane of the target 16. FIG. 4 illustrates a convenient way to indicate to the soldier 50 that he or she is standing the preferred distance D from the target 16. A pair of laser diodes 54 and 56 are mounted to the target 16 and are slightly tilted a predetermined angle a from a center line C perpendicular to the plane of the target 16. The laser beams 54' and 56' emitted from the diodes 54 and 56 are in the visible light range, e.g. red, and criss-cross at the predetermined distance. The soldier 50 merely approaches the target 16 until the red spots overlap on his or her chest, and then steps back one step so that the SAT 10 is at the predetermined distance when the rifle 13 is armed and fired at the target 16. The laser beam will then be substantially perpendicular to the target 16.

The laser diodes may be Class A type and may have a power of one-half milliwatt and emit light at a wavelength of, for example, 635 nanometers. Where the predetermined distance D is ten meters the space S between the laser diodes 54 and 56 may be approximately 0.3 meters and the angle $\alpha$ may be approximately one degree. The laser diodes 54 and 56 may be mounted in holes drilled in the ends of an Aluminum mounting bar (not illustrated). The ends of the bar are bent to achieve precise alignment of the criss-cross beams 54 and 56 before or after being attached to the target 16. The laser diodes 54 and 56 are energized by conventional circuitry (not shown). Other luminous beam sources besides laser diodes could be used such as incandescent or fluorescent lights along with structures for confining or focusing their light beams.

While we have described several embodiments of our infrared laser transmitter alignment verifier and targeting system, it should be apparent to those skilled in the art that our invention may be further modified in arrangement and detail. For example, the utility of our system is not limited to SAT alignment and target practice and instead could be adapted to a wide variety of other applications where it is desirable to detect and visually indicate the point of impact of an energy beam so that its source can be aligned or verified. Therefore, the protection afforded our invention should only be limited in accordance with the scope of the following claims.

We claim:

1. A system for detecting and visually indicating the relative location of the impact of an energy beam emitted from a remote source, comprising:

a target;

a plurality of detectors mounted on the target for generating output signals when struck by a beam of energy emitted from a remote source aimed at the target;

a plurality of luminescent devices mounted on the target for generating visible light when energized;

a circuit connected to the plurality of detectors for receiving the output signals and energizing preselected ones of the luminescent devices to provide a visual indication of a relative location of an impact on the target of the beam of energy; and means mounted on the target for emitting a pair of luminous beams that criss-cross a predetermined distance from the target for indicating the distance.

2. The system of claim 1 wherein the detectors are selected from the group consisting of a photo-diode, a photo-transistor and a photo-darlington.

3. The system of claim 1 wherein the luminescent devices comprise LEDs.

4. The system of claim 1 wherein the luminescent devices are arranged along orthogonal axes corresponding to azimuth and elevation.

5. The system of claim 4 wherein the detectors are clustered around and adjacent to an intersection of the axes.

6. The system of claim 4 wherein the detectors and luminescent devices are arranged on the target to provide an effective magnification of the indicated amount of a variation in azimuth and a variation in an elevation of the location of the impact of the energy beam relative to an intersection of the axes.

7. The system of claim 1 wherein the circuit causes the preselected luminescent devices to be energized for a preselected duration of time that is longer than a duration of the impact of the energy beam on the target.

8. The system of claim 1 wherein the circuit includes a circuit board having a plurality of scales to facilitate parallax adjustments to accommodate different energy beam geometries.

9. The system of claim 1 wherein the circuit includes a plurality of identical sub-circuits each including a set/reset circuit.

10. A method of verifying an alignment of a beam of energy, comprising the steps of:

providing a target with a cross-hair;

aiming a source remote from the target at the target, the source being mounted on a rifle with adjustable iron sights, the source being capable of emitting a beam of energy;

causing the source to emit the beam of energy at the target;

detecting at the target the location of an impact of the beam of energy on the target;

providing at the target a magnified visual indication of the location of the impact; and adjusting an azimuth or an elevation of the source in order to align the beam of energy with the iron sights so that the beam of energy will impact a center of the cross-hair on the target when the center is in the iron sights.

11. The method of claim 10 wherein the beam of energy is an infrared laser beam.

12. The method of claim 10 wherein the beam of energy is an infrared laser beam which is emitted in a pulse of relatively short duration.

13. The method of claim 12 wherein the infrared laser beam has a milliradian of between approximately three and approximately four when emitted.

14. The method of claim 12 wherein a duration of the visual indication is longer than a duration of the pulse.

15. The method of claim 10 wherein the detecting is accomplished utilizing a plurality of detectors mounted in a plurality of clusters spaced adjacent to and around a cross-hair on the target.

16. The method of claim 10 wherein the source is aimed at an intersection of a pair of orthogonal axes on the target and the visual indication is generated energizing by a plurality of luminescent devices arranged along the axes to provide an effective magnification of the variation in an azimuth and a variation in an elevation of the location of the impact of the beam relative to an intersection of the axes.

17. The method of claim 10 and further comprising the step of initially placing the source a predetermined distance from the target.

18. A system for detecting and visually indicating the relative location of the impact of an energy beam emitted from a remote source, comprising:

a planar PCB forming a target;

a plurality of luminescent devices mounted on a first side of the PCB for generating visible light when energized, the luminescent devices being selected from the group consisting of LEDs and incandescent light bulbs, and the luminescent devices being arranged along orthogonal axes corresponding to azimuth and elevation;

a plurality of detectors mounted on first side of the PCB for generating output signals when struck by an infrared laser beam emitted from a remote source aimed at the PCB, the detectors being selected from the group consisting of a photo-diode, a photo-transistor and a photo-darlington, and the detectors being clustered adjacent to and around an intersection of the orthogonal axes;

a circuit mounted on a second side of the PCB and connected to the plurality of detectors for receiving the output signals and energizing preselected ones of the luminescent devices to provide a visual indication of a relative location of an impact on the target of the beam of energy, the circuit causing the preselected luminescent devices to be energized for a preselected duration of time that is longer than a duration of the impact of the energy beam on the target; and the detectors and luminescent devices being arranged on the PCB to provide an effective magnification of a variation in azimuth and a variation in an elevation of the location of the impact of the energy beam relative to the intersection of the axes.

19. A method of verifying an alignment of a beam of energy comprising the steps of providing a target with a cross-hair;

aiming a source remote from the target at the target, the source being mounted on a rifle with a pair of adjustable iron sights, the source being capable of emitting a beam of energy;

causing the source to emit the beam of energy at the target;

detecting at the target the location of an impact of the beam of energy at the target;

providing at the target a magnified visual indication of the location of the impact; and adjusting the iron sights so that the beam will impact a center of the cross-hair on the target when the center of the cross-hair is in the iron sights.

* * * * *